US010288066B2

(12) United States Patent
Watanabe et al.

(10) Patent No.: US 10,288,066 B2
(45) Date of Patent: May 14, 2019

(54) OIL PUMP WITH SLOPING EXTENSION PORTION BETWEEN DISCHARGE

(71) Applicant: YAMADA MANUFACTURING CO., LTD., Kiryu-shi, Gunma (JP)

(72) Inventors: Manabu Watanabe, Kiryu (JP); Shimpei Iizuka, Kiryu (JP); Hiroaki Sato, Kiryu (JP); Kenji Kawashima, Kiryu (JP)

(73) Assignee: YAMADA MANUFACTURING CO., LTD., Kiryu-Shi (JP)

( * ) Notice: Subject to any disclaimer, the term of this patent is extended or adjusted under 35 U.S.C. 154(b) by 325 days.

(21) Appl. No.: 15/374,633

(22) Filed: Dec. 9, 2016

(65) Prior Publication Data

US 2017/0184099 A1 Jun. 29, 2017

(30) Foreign Application Priority Data

Dec. 25, 2015 (JP) ..... 2015-253939

(51) Int. Cl.

| | |
|---|---|
| ***F04C 2/10*** | (2006.01) |
| ***F01C 21/10*** | (2006.01) |
| ***F04C 15/06*** | (2006.01) |
| ***F01M 1/02*** | (2006.01) |

(52) U.S. Cl.

CPC ..... *F04C 15/06* (2013.01); *F01C 21/108* (2013.01); *F01M 1/02* (2013.01); *F04C 2/10* (2013.01); *F04C 2/102* (2013.01); *F01M 2001/0238* (2013.01); *F04C 2210/206* (2013.01); *F04C 2240/30* (2013.01)

(58) Field of Classification Search

CPC ..... F04C 15/06; F04C 2240/30; F04C 2/10

See application file for complete search history.

(56) References Cited

U.S. PATENT DOCUMENTS

| | | | | |
|---|---|---|---|---|
| 7,435,066 | B2 * | 10/2008 | Enzaka | F04C 15/06 418/58 |
| 9,074,500 | B2 * | 7/2015 | Jung | F04C 15/06 |
| 2017/0227003 | A1 * | 8/2017 | Oowaki | F04C 15/06 |

FOREIGN PATENT DOCUMENTS

| | | |
|---|---|---|
| JP | 4160963 | 7/2008 |

* cited by examiner

*Primary Examiner* — Mary Davis

(74) *Attorney, Agent, or Firm* — Rankin, Hill & Clark LLP

(57) ABSTRACT

A housing of an oil pump includes a suction port, a discharge port, and a partitioning section formed to partition the suction port and the discharge port. The discharge port has discharge groove portions each formed in a groove shape so as to introduce oil from the partitioning section, and an extension portion formed adjacent to the discharge groove portions and extending continuously from an end of the partitioning section. The extension portion has a taper surface extending from an end of an upper surface of the partitioning section to form a downward slope.

4 Claims, 10 Drawing Sheets

θ1

θ2

(COMPARATIVE EXAMPLE)

(EMBODIMENT)

OIL PUMP WITH SLOPING EXTENSION PORTION BETWEEN DISCHARGE

FIELD OF THE INVENTION

The present invention relates to an oil pump driven by an external drive source.

BACKGROUND OF THE INVENTION

Oil pumps are used in vehicle engines to circulate engine oil inside the engines. The oil pumps are connected to and driven by an external drive source such as a crankshaft. One of such oil pumps is disclosed, for example, in Japanese Patent (JP) No. 4160963. The oil pump disclosed in JP 4160963 is shown in FIGS. 11 and 12 hereof.

As shown in FIG. 11, a conventional oil pump 210 includes a rotating shaft 211, an inner rotor 212 attached to the rotating shaft 211, an outer rotor 213 surrounding the inner rotor 212 and rotated by the inner rotor 212, and a housing 220 within which the rotating shaft 211, the inner rotor 212 and the outer rotor 213 are housed.

FIG. 12 is a view illustrating the housing shown in FIG. 11 with the rotating shaft, the inner rotor and the outer rotor removed. As shown in FIG. 12, the housing 220 includes a suction port 231 from which oil is sucked in, a discharge port 240 from which the oil is discharged, and a partitioning section 233 formed to partition the suction port 231 and the discharge port 240. The discharge port 240 has discharge groove portions 241, 242 formed at a part thereof so as to introduce the oil from the partitioning section 233. The discharge groove portions 241, 242 are formed to become gradually deeper along a direction in which the oil flows.

Referring back to FIG. 11, when an engine is operated, a crankshaft is rotated, and the rotating shaft 211 connected to the crankshaft is caused to rotate. As the rotating shaft 211 rotates, the inner rotor 212 is thereby caused to rotate. Then, the outer rotor 213 partially engaged with the inner rotor 212 is caused to rotate.

At the suction port 231, oil is filled in a space Sp formed by the inner rotor 212 and the outer rotor 213. In accordance with the rotation of the inner rotor 212 and the outer rotor 213, the space Sp moves over the partitioning section 233, and then reaches the discharge port 240. The oil carried to the discharge port 240 is discharged from the discharge port 240 to the outside of the oil pump 210.

In the oil pump 210, the discharge groove portions 241, 242 are formed adjacent to the partitioning section 233. With the discharge groove portions 241, 242 formed to become gradually deeper, flow passage area of oil becomes gradually larger. By making the flow passage area gradually larger, a sudden change of oil flow rate is suppressed. As a result, it is possible to prevent occurrence of cavitation in the housing and prolong a lifetime of the oil pump 210.

In the conventional oil pump, however, when the space Sp reaches an end of the partitioning section 233, the flow passage area increases at this position. The sudden increase in the flow passage area at this position would cause a cavitation in the housing. There is still room for further improvement in this regard.

SUMMARY OF THE INVENTION

It is therefore an object of the present invention to provide an oil pump which is capable of providing a moderate change in flow passage area at a discharge port.

According to the present invention, there is provided an oil pump comprising: a rotating shaft adapted to be rotated by an external drive source; an inner rotor attached to the rotating shaft; an outer rotor surrounding the inner rotor 12 and rotated by the inner rotor; and a housing within which the rotating shaft, the inner rotor and the outer rotor are housed, the housing including a suction port from which oil is sucked in, a discharge port from which the oil is discharged, and a partitioning section formed to partition the suction port and the discharge port, wherein the discharge port has discharge groove portions each formed in a groove shape so as to introduce the oil from the partitioning section, and an extension portion formed adjacent to the discharge groove portions and extending continuously from an end of the partitioning section, and wherein the extension portion has a taper surface extending from an end of an upper surface of the partitioning section to form a downward slope.

In the invention, the extension portion formed adjacent to the discharge groove portions and extending continuously from the end of the partitioning section has the taper surface extending from the end of the upper surface of the partitioning section to form the downward slope. With the extension portion having the taper surface, an increase in flow passage area from the end of the partitioning section can be made moderate. It is thereby possible to prevent occurrence of cavitation in the housing and prolong a lifetime of the oil pump.

Preferably, the discharge groove portions each have a part extending from the end of the upper surface of the partitioning section to form a downward slope, and preferably, an inclination angle of at least a part of the discharge groove portions is set to be greater than an angle of inclination of the extension portion.

In the invention, the inclination angle of at least the part of the discharge groove portions is set to be greater than the inclination angle of the extension portion. With this configuration, changes in the flow passage area and flow rate can be performed basically on the discharge groove portions. Additionally, with the extension portion having a relatively gentle inclination angle, the changes in the flow passage area and the flow rate can be finely adjusted.

Preferably, the discharge groove portions are constituted by an inner-periphery side discharge groove portion and an outer-periphery side discharge groove portion formed, respectively, on an inner side of the extension portion and an outer side of the extension portion with respect to an axial center line of the rotating shaft, wherein the inner-periphery side discharge groove portion has a bottom surface extending with a downward inclination from the end of the partitioning section toward a downstream side with respect to a direction of flow of the oil, and wherein the outer-periphery side discharge groove portion has a bottom surface, and at least a part of the bottom surface of the outer-periphery side discharge groove portion has an angle of inclination greater than an angle of inclination of the bottom surface of the inner-periphery side discharge groove portion.

Preferably, the outer-periphery side discharge groove portion has a groove width which becomes wider as going apart from the partitioning section.

BRIEF DESCRIPTION OF THE DRAWINGS

A certain preferred embodiment of the present invention will be described in detail below, by way of example only, with reference to the accompanying drawings, in which.

DETAILED DESCRIPTION OF THE PREFERRED EMBODIMENT

In FIGS. 1 through 10, there is shown an oil pump according to an embodiment of the present invention. Below will be described in detail the embodiment of the present invention with reference to the accompanying drawings.

Embodiment

Figure 1:
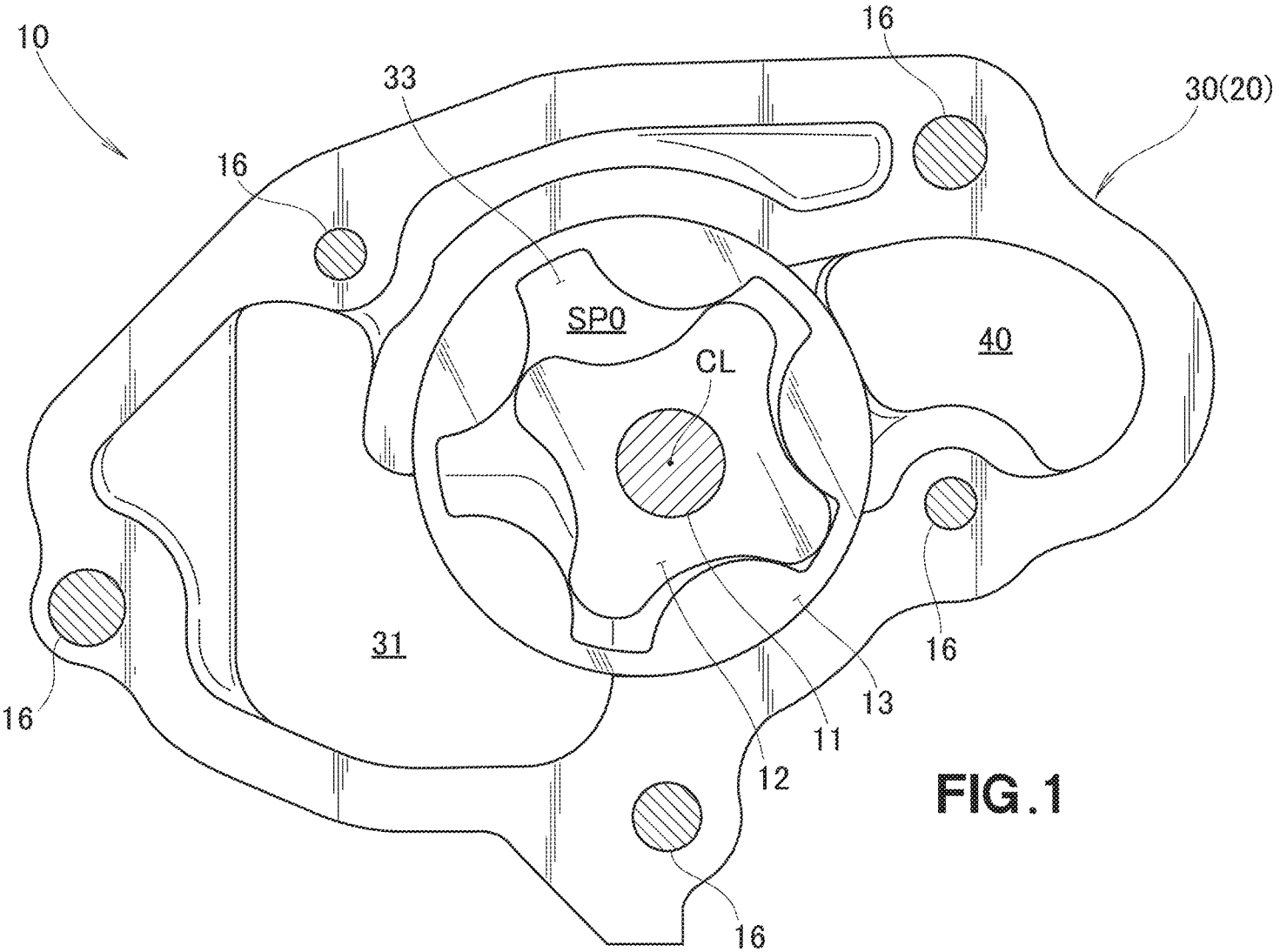
FIG. 1 is a plan view showing an oil pump according to the embodiment of the present invention.

As shown in FIG. 1, an oil pump 10 is a so-called trochoid pump. The oil pump 10 has a rotating shaft 11 connected to, for example, a crankshaft of an engine (as an external drive source). The oil pump 10 includes an inner rotor 12 attached to the rotating shaft 11, and an outer rotor 13 surrounding the inner rotor 12. The outer rotor 13 is partially engaged with the inner rotor 12. When the inner rotor 12 is rotated, the outer rotor 13 is pushed and rotated by the inner rotor 12. The oil pump 10 further includes a housing 20 within which the rotating shaft 11, the inner rotor 12 and the outer rotor 13 are housed.

The housing 20 is composed of a lower housing member 30, and an upper housing member mounted to cover the lower housing member 30. The lower housing member 30 and the upper housing member are fastened by means of a plurality of bolts 16 and nuts.

The rotating shaft 11 can be connected not only to the crankshaft but also to any optional member such as a camshaft. That is, the external drive source is not limited to the crankshaft of the engine.

Figure 2:
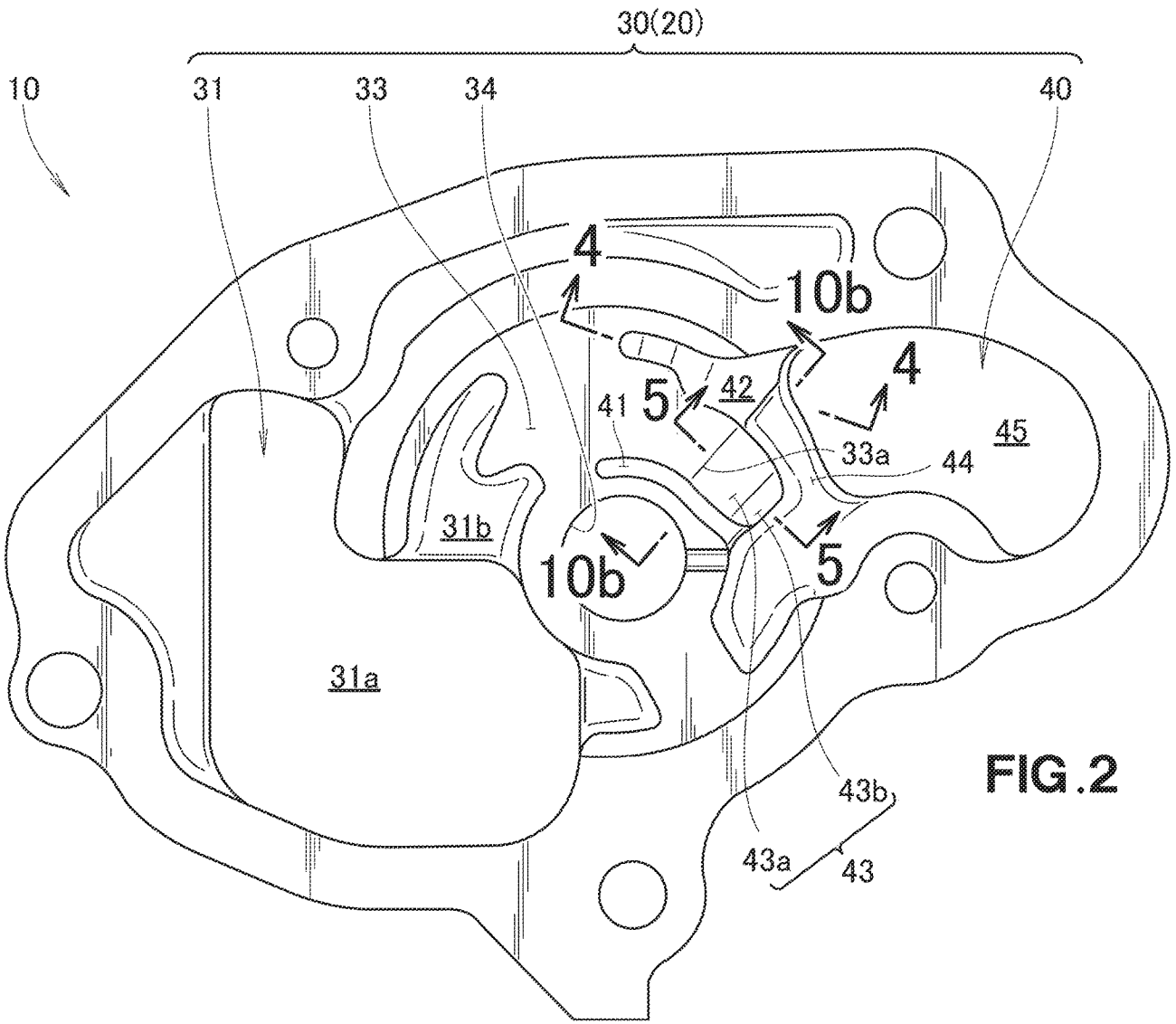
FIG. 2 is a plan view of a lower housing member shown in FIG. 1 with a rotating shaft, an inner rotor and an outer rotor removed.

As shown in FIG. 2, the lower housing member 30 includes a suction port 31 from which oil is sucked in, a discharge port 40 from which the oil is discharged, a partitioning section 33 formed to partition the suction port 31 and the discharge port 40, and a rotating shaft insertion hole 34 for insertion of the rotating shaft 11 (FIG. 1).

Referring also to FIG. 1, the suction port 31 is a part which allows oil to flow therefrom and fill in a space SP0 formed by the inner rotor 12 and the outer rotor 13. The discharge port 40 is a part which discharges the oil after being carried by the inner rotor 12 and the outer rotor 13. That is, the suction port 31 and the discharge port 40 constitute an oil flow passages.

The suction port 31 has, as shown in FIG. 2, a suction opening 31*a* connected to the outside of the oil pump 10, and a suction groove portion 31*b* formed in a groove shape and connected to the partitioning section 33.

Figure 3:
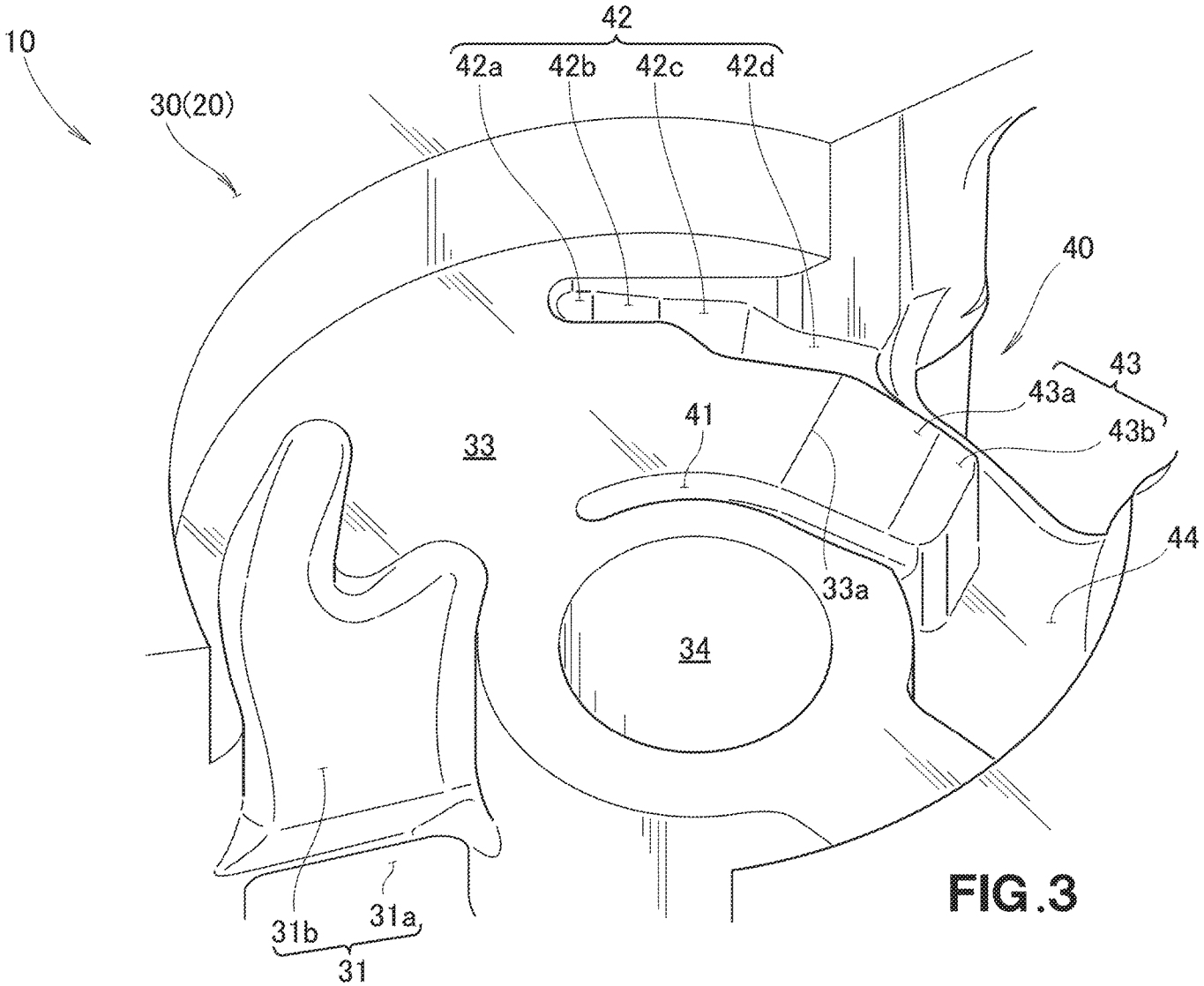
FIG. 3 is a perspective view of the lower housing member shown in FIG. 2.

Referring also to FIG. 3, the discharge port 40 has an inner-periphery side discharge groove portion 41 and an outer-periphery side discharge groove portion 42 (discharge groove portions 41, 42) each formed in a groove shape so as to introduce the oil from the partitioning section 33, an extension portion 43 formed between the discharge groove portions 41, 42 and extending continuously from an end 33*a* of the partitioning section 33, a discharge bottom 44 located at a deepest position with respect to the partitioning section 33, and a discharge opening 45 formed continuously with an end of the discharge bottom 44 and connected to the outside of the oil pump 10.

The inner-periphery side discharge groove portion 41 is formed in the vicinity of the rotating shaft insertion hole 34 compared to the outer-periphery side discharge groove portion 42. Namely, the inner-periphery side discharge groove portion 41 is located on the inner periphery side more than the outer-periphery side discharge groove portion 42 with respect to an axial center line CL (FIG. 1) of the rotating shaft 11 (FIG. 1).

The inner-periphery side discharge groove portion 41 has a substantially uniform groove width. The inner-periphery side discharge groove portion 41 has a groove depth which becomes gradually deeper from the partitioning section 33 toward the discharge bottom 44. In other words, the inner-periphery side discharge groove portion 41 has an inclined bottom surface with respect to a plane perpendicular to the axial center line of the rotating shaft 11 (FIG. 1). That is, the bottom surface of the inner-periphery side discharge groove portion 41 is inclined with respect to an upper surface of the partitioning section 33.

The outer-periphery side discharge groove portion 42 has a groove width which becomes wider as going apart from the partitioning section 33 in a circumferential direction.

Figure 4:
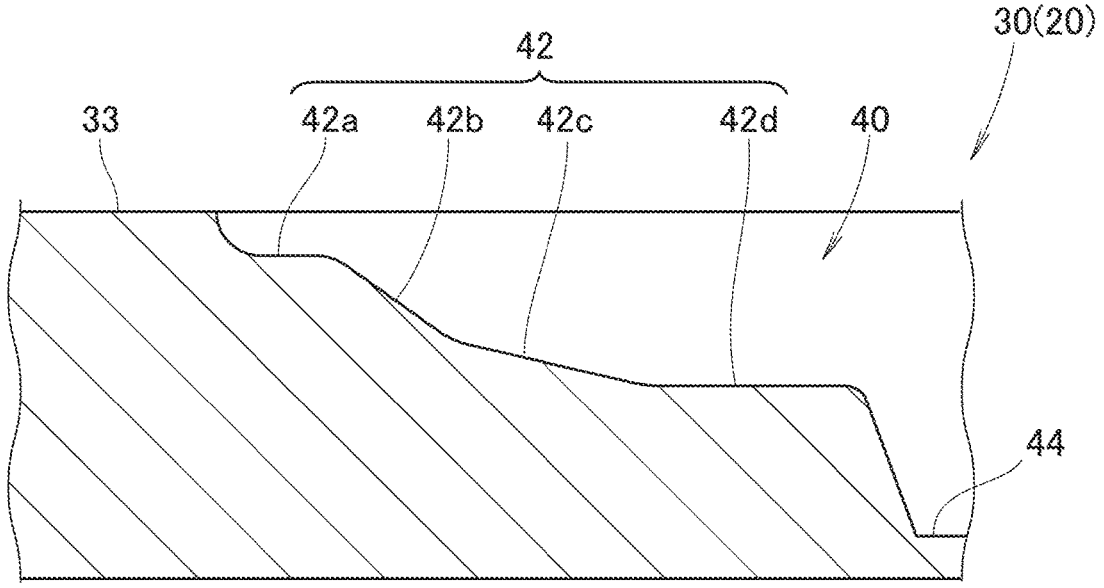
FIG. 4 is a cross-sectional view taken along line 4-4 of FIG. 2.

As shown in FIG. 4, the outer-periphery side discharge groove portion 42 has a groove depth which becomes gradually deeper from the end of the partitioning section 33 toward the discharge bottom 44. The outer-periphery side discharge groove portion 42 has a bottom surface formed by a groove flat surface 42*a* formed adjacent to the partitioning section 33 and extending substantially parallel to the upper surface of the partitioning section 33, a first groove taper surface 42*b* extending continuously from the groove flat surface 42*a* to form a downward slope, a second groove taper surface 42*c* extending continuously from the first groove taper surface 42*b* to form a downward slope more gently than that of the first groove taper surface 42*b*, and a third groove taper surface 42*d* extending continuously from the second groove taper surface 42*c* to form a downward slope more gently than that of the second groove taper surface 42*c*.

Figure 5:
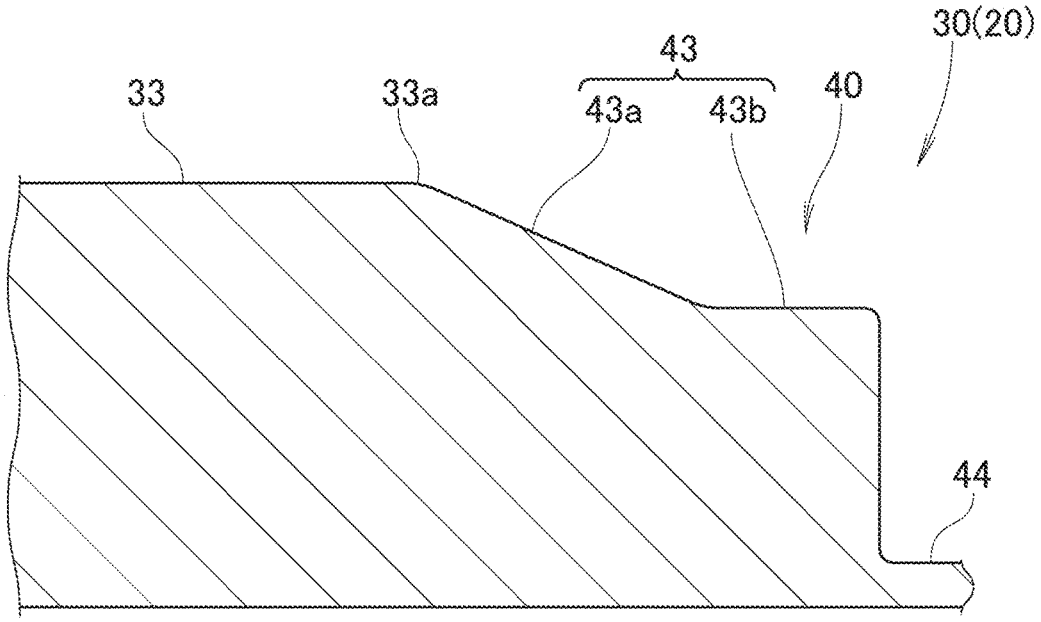
FIG. 5 is a cross-sectional view taken along line 5-5 of FIG. 2.

As shown in FIGS. 3 and 5, the extension portion 43 has a taper surface 43*a* extending from the end 33*a* of the upper surface of the partitioning section 33 to form a downward slope. The taper surface 43*a* constitutes a part of an upper surface of the extension portion 43. The taper surface 43*a* is inclined with respect to the upper surface of the partitioning section 33. The extension portion 43 further has an extension flat surface 43*b* extending from an end of the taper surface 43*a* toward the discharge bottom 44 in substantially parallel to the upper surface of the partitioning section 33.

As shown in FIGS. 4 and 5, an inclination angle of at least a part of the bottom surface of the outer-periphery side discharge groove portion 42 (for example, the first groove taper surface 42*b*) is greater than that of the taper surface 43*a* of the extension portion 43. With this configuration, changes in flow passage area and flow rate can be performed basically on the outer-periphery side discharge groove portion 42. Additionally, with the extension portion 43 having a relatively gentle inclination angle, the changes in the flow passage area and the flow rate can be finely adjusted.

As shown in FIG. 2, the bottom surface of the inner-periphery side discharge groove portion 41 extends from the end of the partitioning section 33 toward the discharge bottom 44 (discharge opening 45) to form a downward slope. An inclination angle of the bottom surface of the inner-periphery side discharge groove portion 41 is substantially constant. The inclination angle of at least the part of the bottom surface of the outer-periphery side discharge groove portion 42 (for example, the first groove taper surface 42*b* (FIG. 4)) is greater than the inclination angle of the bottom surface of the inner-periphery side discharge groove portion 41. With this configuration, the changes in the flow passage area and the flow rate can be performed basically on the outer-periphery side discharge groove portion 42. Additionally, with the inner-periphery side discharge groove portion 41 having such a relatively gentle inclination angle, the changes in the flow passage area and the flow rate can be finely adjusted.

Namely, the two discharge groove portions 41, 42 are formed with the extension portion 43 disposed therebetween. The discharge groove portions 41, 42 are constituted by the inner-periphery side discharge groove portion 41 and the outer-peripheral side discharge groove portion 42 formed, respectively, on an inner side of the extension portion 43 and an outer side of the extension portion 43 with respect to the axial center line CL (FIG. 1) of the rotating shaft 11. The bottom surface of the inner-periphery side discharge groove portion 41 forms the downward slope extending from the end of the partitioning section 33 toward the discharge bottom 44 (discharge opening 45). The inclination angle of at least the part of the bottom surface of the outer-periphery side discharge groove portion 42 (for example, the first groove taper surface 42*b* (FIG. 4)) is greater than the inclination angle of the bottom surface of the inner-periphery side discharge groove portion 41.

A comparison was made between the oil pump according to the embodiment described above and an oil pump according to a comparative example.

Figure 6:
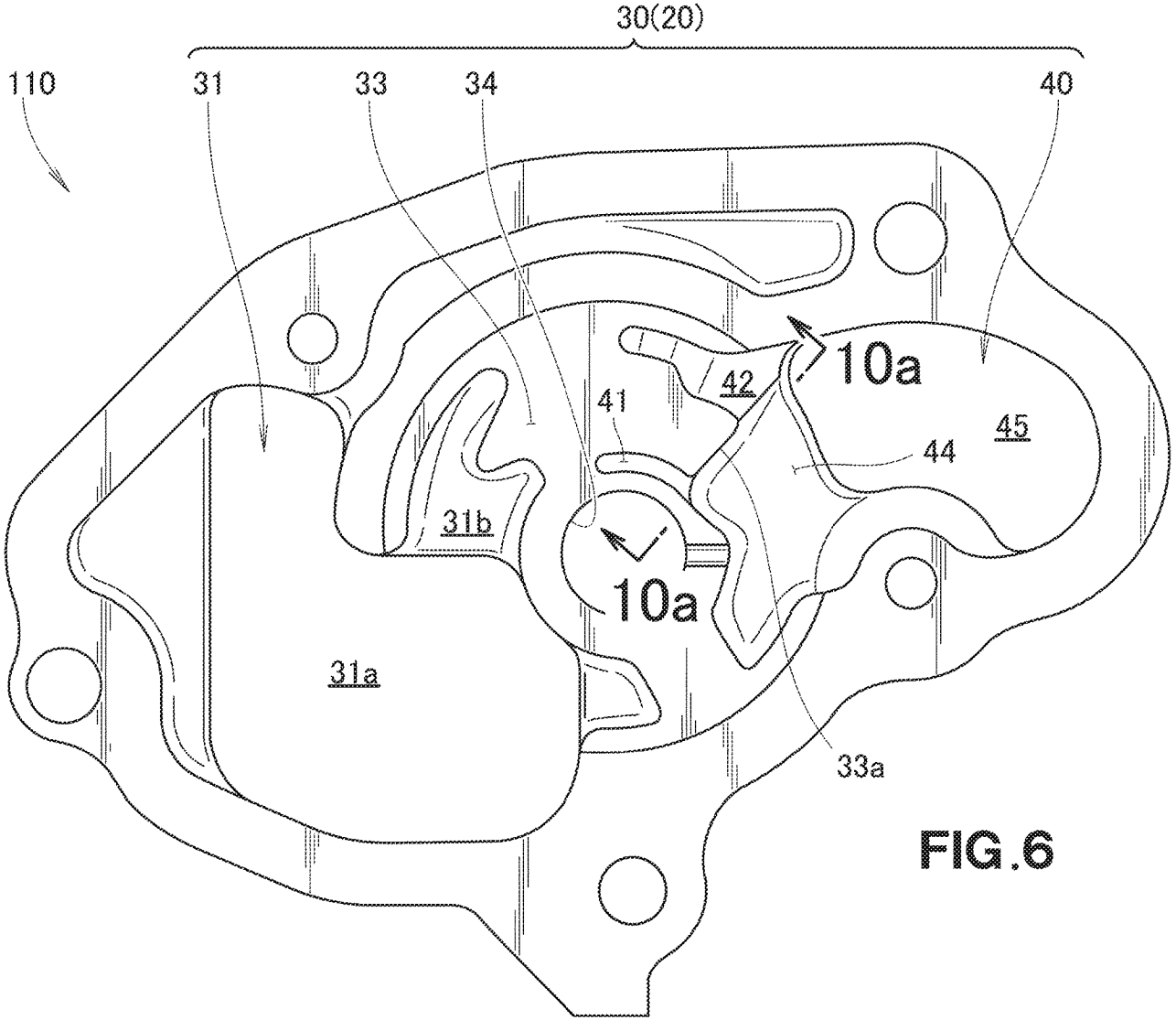
FIG. 6 is a plan view showing a lower housing member of an oil pump according to a comparative example.

In FIG. 6, the oil pump 110 according to the comparative example is shown. Compared to the oil pump 10 (FIG. 2) according to the embodiment, the oil pump 110 according to the comparative example does not include the extension portion 43 (FIG. 2). Other than that, the oil pump 110 has the same configuration with the oil pump shown in FIGS. 1 and 2.

The inner rotor 12 is rotated from a reference position formed by the position of the inner rotor 12 shown in FIG. 1. It is measured how the flow passage area is changed in each of the oil pumps with respect to rotation angles by which the inner rotor 12 is rotated. Further, it is measured how the flow rate is changed with respect to the rotation angle of the inner rotor 12.

Figure 7:
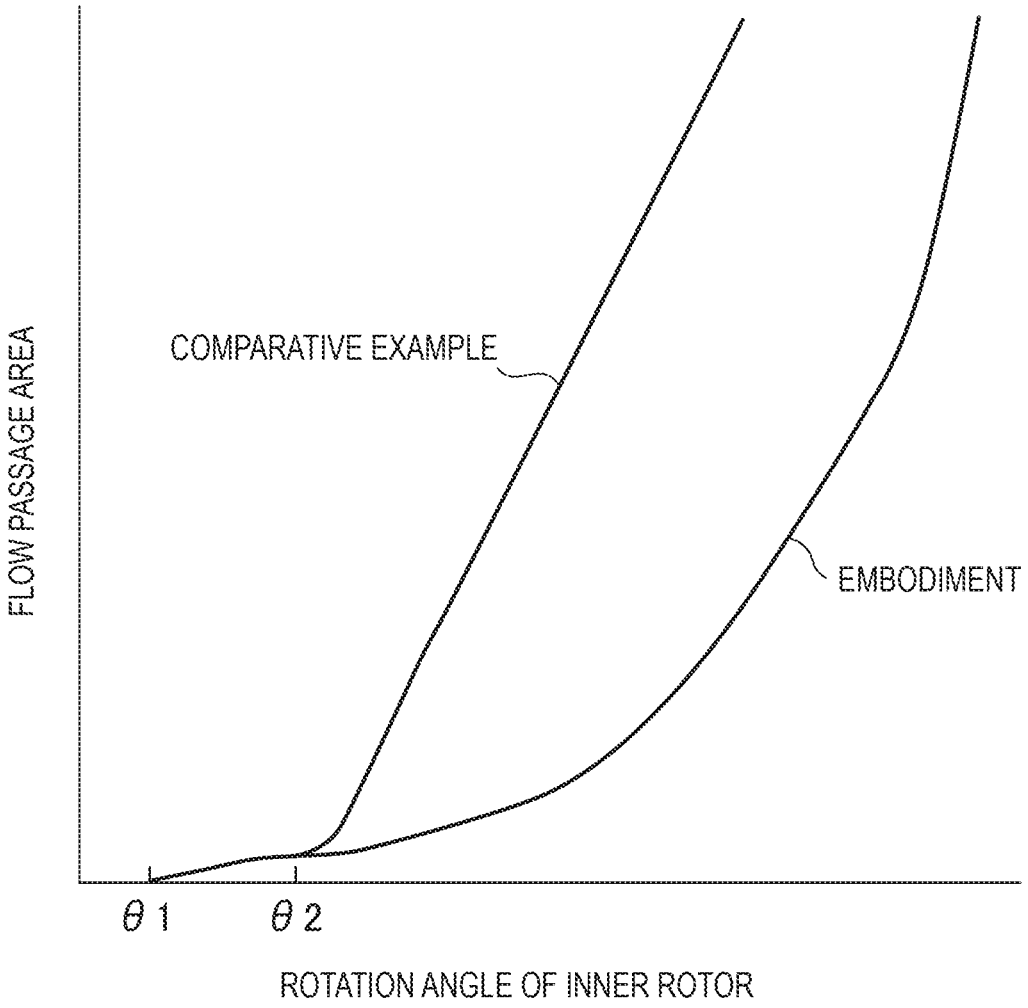
FIG. 7 is a graph illustrating a relationship between the rotation angle of the inner rotor shown in FIG. 1 and the flow passage area.

FIG. 7 is a graph with a horizontal axis representing the rotation angle of the inner rotor and a vertical axis representing the flow passage area, which shows how the flow passage area of oil flowing from the space SP0 toward the discharge port 40 is changed in each of the oil pumps with respect to the rotation angle by which the inner rotor is rotated.

When the rotation angle of the inner rotor is in a range of 0° to θ1, the flow passage areas are both zero in the comparative example and the embodiment. While the rotation angle of the inner rotor is in a range of θ1 to θ2, the flow passage areas gradually increase both in the comparative example and the embodiment. During this section, the changes in the flow passage area in the comparative example and the embodiment are substantially the same to each other.

When the rotation angle of the inner rotor exceeds θ2, the flow passage area in the oil pump 110 (FIG. 6) of the comparative example suddenly increases compared to the oil pump 10 (FIG. 2) of the embodiment. In other words, in the oil pump 10 according to the embodiment, the flow passage area changes moderately at the discharge port 40.

Herein, an oil flow quantity Q can be obtained by the following formula: $Q=S\times V$, where S represents the flow passage area, and V represents the flow rate of oil. The flow passage area when the rotation angle of the inner rotor is θ2 is defined as S', and the flow rate at this point is defined as V'. Further, the flow passage area at an arbitrary position after the rotation angle of the inner rotor exceeded θ2 is defined as S", and the flow rate at this point is defined as V". If the oil flow quantity Q in the same oil pump is kept constant, the following formula is established: $Q=S'\times V'=S''\times V''$. Here, when S' is less than S", V' is greater than V". When the difference between S' and S" is large, the difference between V' and V" becomes large.

Figure 8:
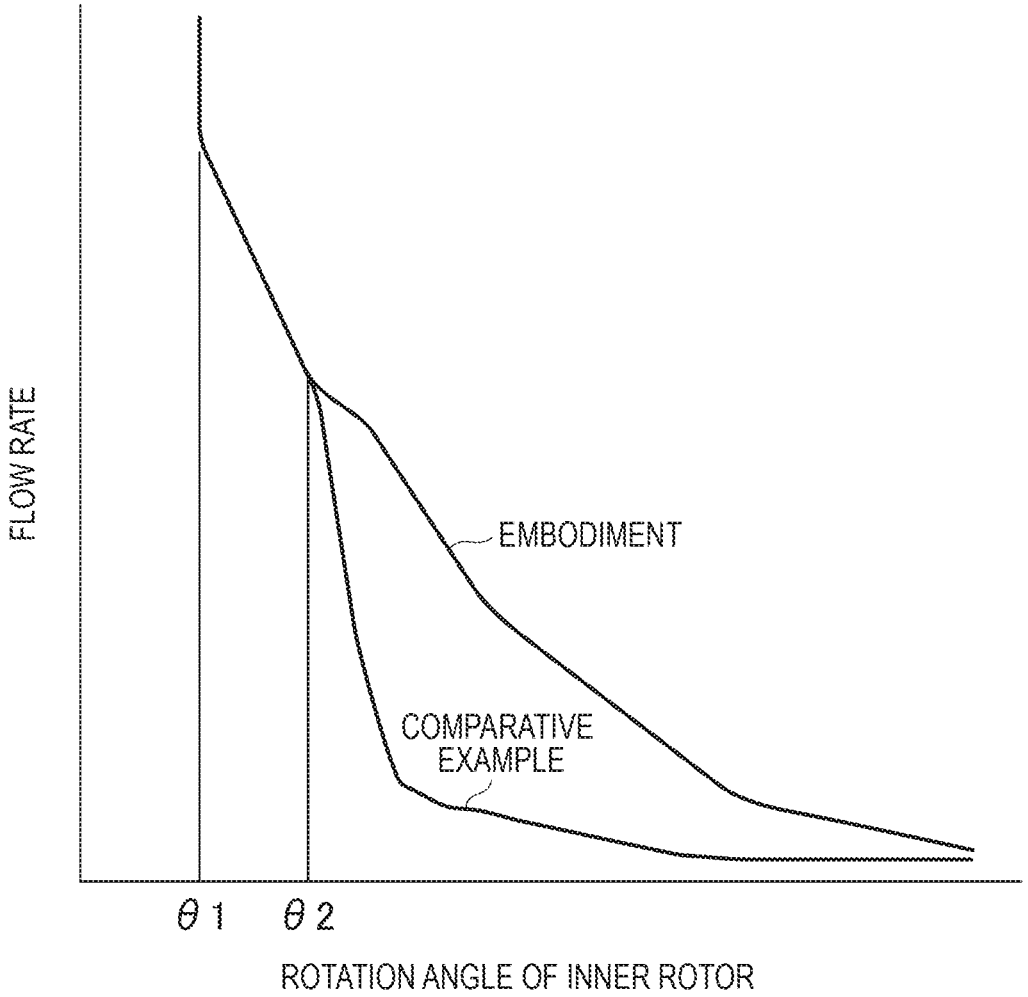
FIG. 8 is a graph illustrating a relationship between the rotation angle of the inner rotor shown in FIG. 1 and the flow rate of oil.

FIG. 8 is a graph with a horizontal axis representing the rotation angle of the inner rotor and a vertical axis representing the flow rate, which shows how the flow rate of oil is changed in each of the oil pumps with respect to the rotation angle by which the inner rotor is rotated.

As noted above, when the rotation angle of the inner rotor exceeds θ2, the flow passage area in the oil pump 110 (FIG. 6) of the comparative example suddenly increases compared to the oil pump 10 (FIG. 2) of the embodiment. Therefore, the oil flow rate in the oil pump 110 of the comparative example is suddenly reduced when the rotation angle of the inner rotor exceeds θ2. In the oil pump 10 according to the embodiment, since the flow passage area changes moderately at the discharge port 40, the oil flow rate is reduced moderately.

Below will be described in more detail how the above-described results are obtained, with reference to FIGS. 1, 9*a* and 9*b*.

The inner rotor 12 is rotated clockwise from the reference position shown in FIG. 1. The rotation angle of the inner rotor shown in FIG. 1 is 0°, and the rotation angle of the inner rotor shown in FIG. 9*a* is θ1. While the rotation angle of the inner rotor is in the range of 0° to θ1, the space SP0 and a space SP1 formed by the inner rotor 12 and the outer rotor 13 are entirely located above the partitioning section 33 even though the shapes are changed. Therefore, the flow passage area is zero.

Figure 9A:
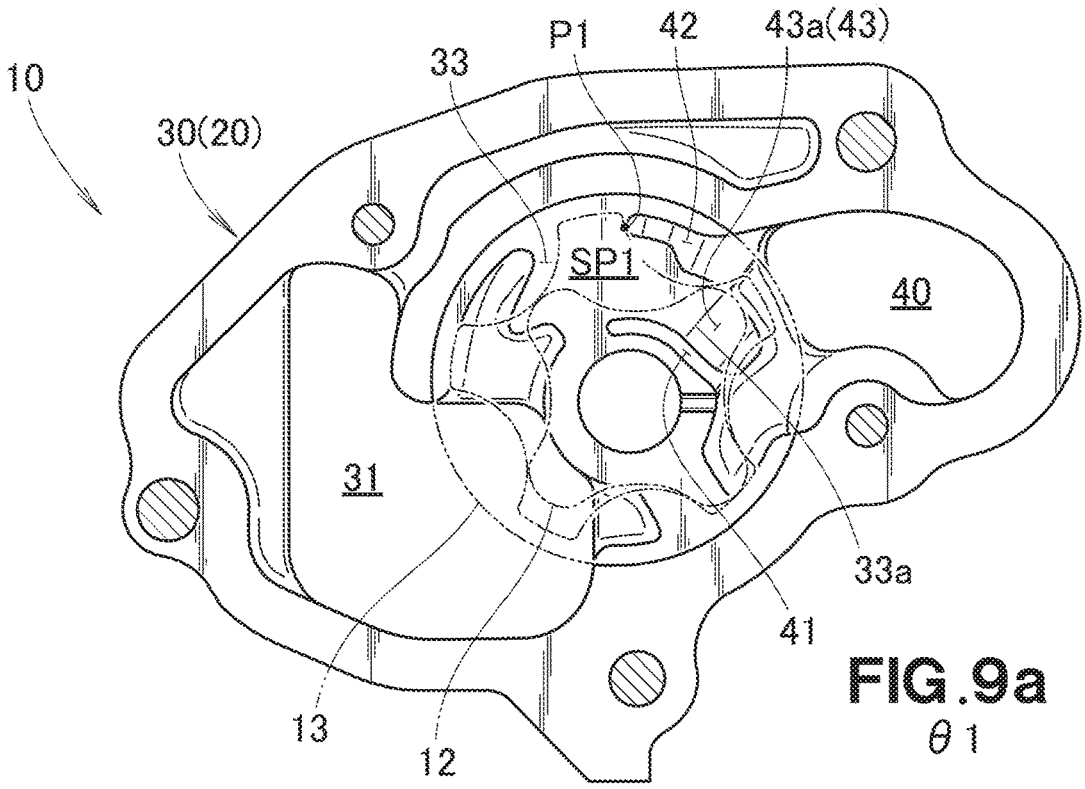
FIGS. 9*a* and 9*b* are views illustrating an operation of the oil pump according to the present invention shown in FIG. 1.

As shown in FIG. 9*a*, when the rotation angle of the inner rotor is θ1, an end P1 of the space SP1 coincides an end of the outer-periphery side discharge groove portion 42. When the inner rotor 12 is further rotated clockwise from this position, the space SP1 is brought into communication with the outer-periphery side discharge groove portion 42. Since the groove depth of the outer-periphery side discharge groove portion 42 becomes gradually deeper, the flow passage area increases gradually.

Figure 9B:
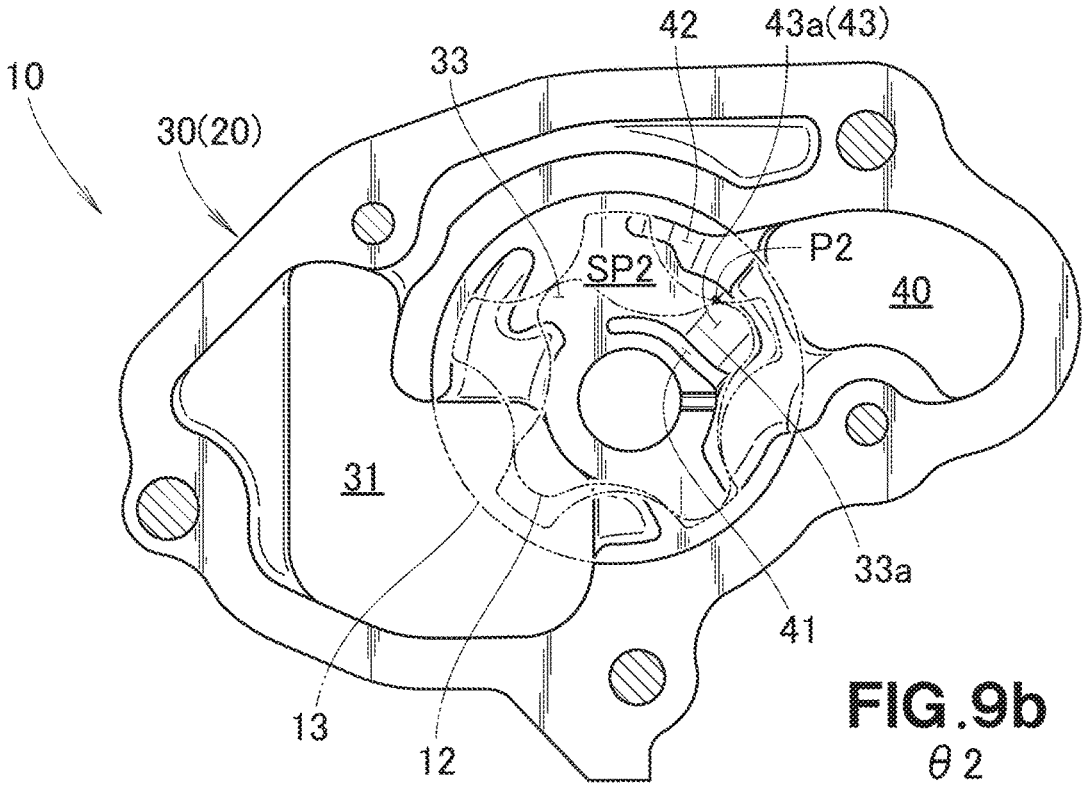

As shown in FIG. 9*b*, when the rotation angle of the inner rotor is θ2, an end P2 of a space SP2 coincides the end 33*a* of the partitioning section 33. When the inner rotor 12 is further rotated clockwise from this position, part of the space SP2 is located above the taper surface 43*a*.

Figure 10A:
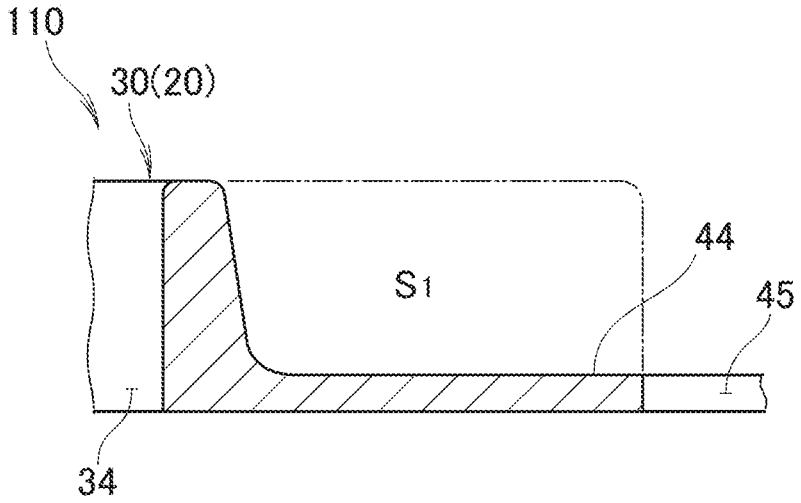
FIGS. 10*a* and 10*b* are views comparatively illustrating a difference between the oil pump according to the comparative example shown in FIG. 6 and the oil pump according to the present invention shown in FIG. 2.
Figure 10B:
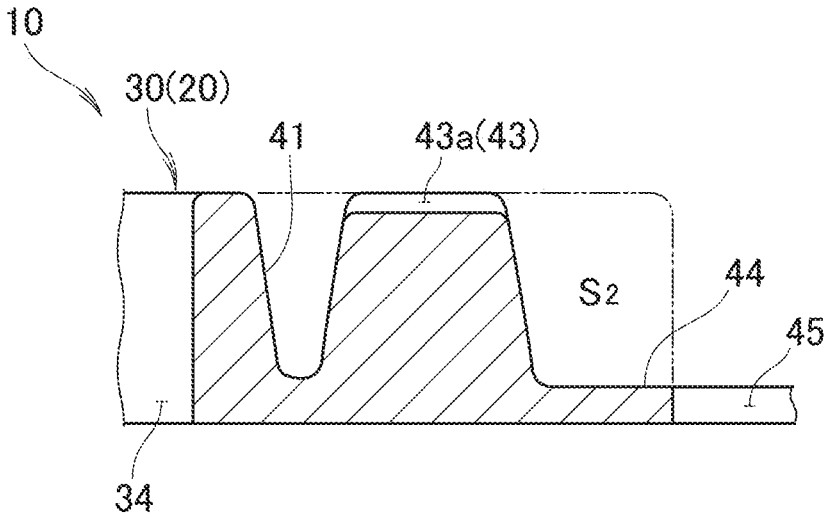
Figure 11:
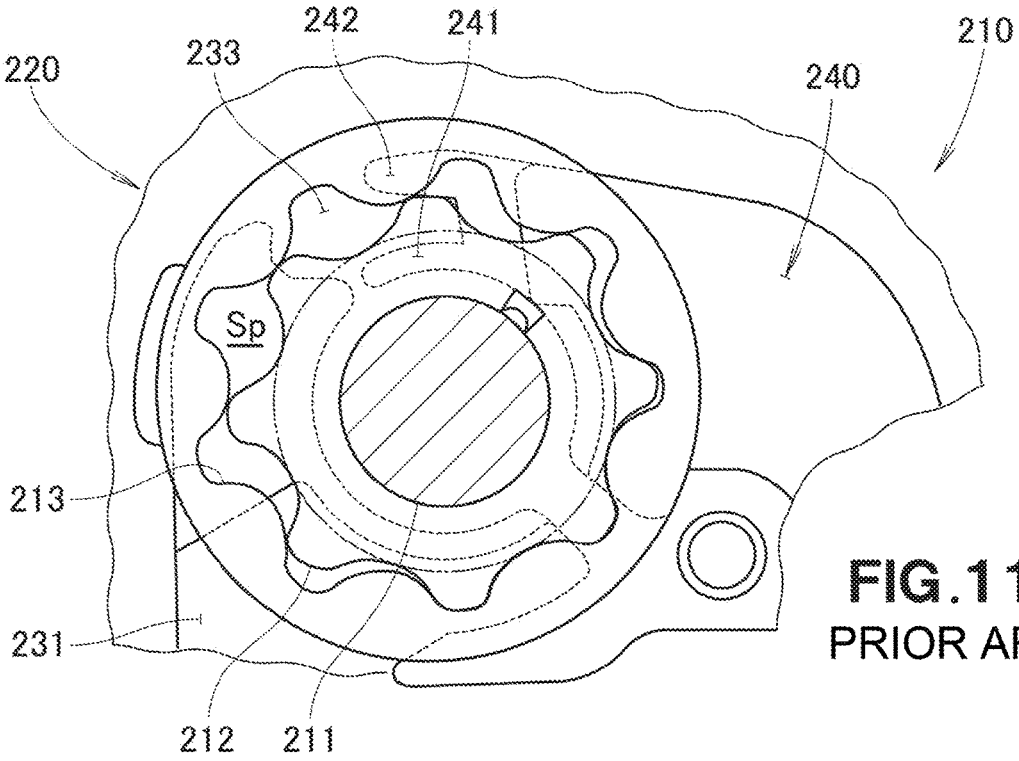
FIG.11 PRIOR ART
FIG. 11 is a view illustrating a basic configuration of a conventional oil pump.
Figure 12:
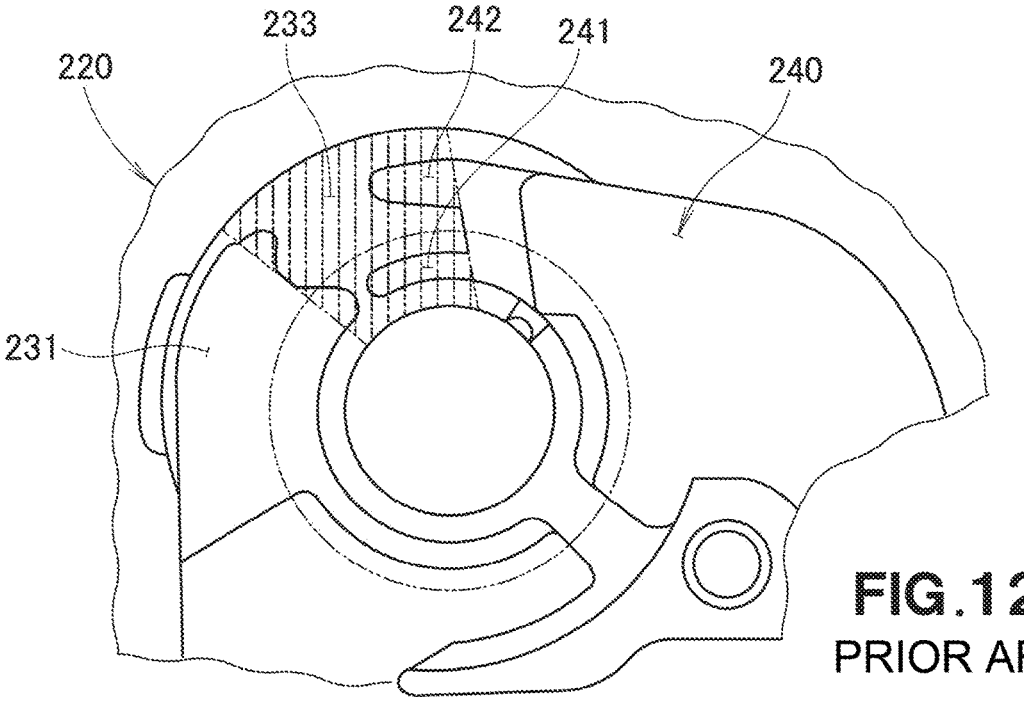
FIG.12 PRIOR ART
FIG. 12 is a plan view of a lower housing member shown in FIG. 11 with a rotating shaft, an inner rotor and an outer rotor removed.

Referring also to FIGS. 10*a* and 10*b*, in the oil pump 110 according to the comparative example shown in FIG. 10*a* which does not include the extension portion 43 (FIG. 10*b*), the flow passage area suddenly increases when the rotation angle of the inner rotor exceeds θ2. The flow passage area at this position is S1.

By contrast, in the oil pump 10 according to the embodiment shown in FIG. 10*b* which includes the extension portion 43, the flow passage area increases moderately even when the rotation angle of the inner rotor exceeds θ2. In other words, the flow passage area S2 at a position when the rotation angle of the inner rotor slightly exceeds θ2 is slightly greater than the flow passage area when the rotation angle of the inner rotor is θ2. Further, with the taper surface 43*a* constituting the part of the upper surface of the extension portion 43, the change in the flow passage area can be made moderate even when the inner rotor 12 is further rotated.

Namely, the extension portion 43 has the taper surface 43*a* extending from the end 33*a* of the upper surface of the partitioning section 33 to form the downward slope. With the extension portion 43 having the taper surface 43*a*, the increase in the flow passage area from the end 33*a* of the partitioning section 33 can be made moderate. It is thereby possible to prevent occurrence of cavitation in the housing 20 and prolong a lifetime of the oil pump 10.

Whereas the embodiment has been explained in the case where the suction port 31, the discharge port 40 and the partitioning section 33 are formed in the lower housing member 30, they may be formed in the upper housing member. Or further, they may be formed in both the lower housing member 30 and the upper housing member. Also, the discharge groove portions 41, 42 and the extension portion 43 may be formed in the upper housing member.

Thus, the present invention is not limited to the above-described embodiment as long as the advantageous effects of the invention are obtained. Obviously, various minor changes and modifications of the present invention are possible in light of the above teaching. It is therefore to be understood that within the scope of the appended claims the invention may be practiced otherwise than as specifically described.

INDUSTRIAL APPLICABILITY

The oil pump of the present invention is well suited for use in four-wheel vehicles.

REFERENCE CHARACTERS

10: oil pump,
11: rotating shaft,
12: inner rotor,
13: outer rotor,
20: housing,
31: suction port,
33: partitioning section,
40: discharge port,
41: inner-periphery side discharge groove portion (discharge groove portion)
42: outer-periphery side discharge groove portion (discharge groove portion)
43: extension portion,
43*a*: taper surface

What is claimed is:

1. An oil pump comprising:

a rotating shaft adapted to be rotated by an external drive source;

an inner rotor attached to the rotating shaft;

an outer rotor surrounding the inner rotor and rotated by the inner rotor; and a housing within which the rotating shaft, the inner rotor and the outer rotor are housed, the housing including a suction port from which oil is sucked in, a discharge port from which the oil is discharged, and a partitioning section formed to partition the suction port and the discharge port, wherein the discharge port has first and second discharge grooves, each of said first and second discharge grooves being formed in a groove shape so as to introduce the oil from the partitioning section, and an extension portion that is adjacent and between the first and second discharge grooves and that extends continuously from an end of the partitioning section, and wherein the extension portion has a taper surface extending from an end of an upper surface of the partitioning section to form a downward slope.

2. The oil pump according to claim 1, wherein each of the first and second discharge grooves have a part extending from the end of the upper surface of the partitioning section to form a downward slope, and wherein an inclination angle of at least a part of the first and second discharge grooves is set to be greater than an angle of inclination of the extension portion.

3. The oil pump according to claim 1, wherein the first and second discharge grooves are constituted by an inner-periphery side discharge groove and an outer-periphery side discharge groove formed, respectively, on an inner side of the extension portion and an outer side of the extension portion with respect to an axial center line of the rotating shaft, wherein the inner-periphery side discharge groove has a bottom surface extending with a downward inclination from the end of the partitioning section toward a downstream side with respect to a direction of flow of the oil, and wherein the outer-periphery side discharge groove has a bottom surface, and at least a part of the bottom surface of the outer-periphery side discharge groove has an angle of inclination greater than an angle of inclination of the bottom surface of the inner-periphery side discharge groove.

4. The oil pump according to claim 3, wherein the outer-periphery side discharge groove has a groove width which becomes wider from the partition section with respect to the direction of flow of the oil.

* * * * *